US006520158B1

(12) United States Patent
Mills

(10) Patent No.: US 6,520,158 B1
(45) Date of Patent: Feb. 18, 2003

(54) ENGINE FUEL DELIVERY CONTROL SYSTEM

(75) Inventor: Wayne Lee Mills, Janesville, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 09/724,017

(22) Filed: Nov. 28, 2000

(51) Int. Cl.[7] ..... F02D 17/00

(52) U.S. Cl. ..... 123/481; 123/198 DB; 123/198 F

(58) Field of Search ..... 123/481, 491, 123/492, 198 D, 198 DB, 198 F, 366, 685, 686, 689

(56) References Cited

U.S. PATENT DOCUMENTS 3,896,779 A * 7/1975 Omori et al. ..... 123/198 F
4,499,876 A 2/1985 Yamamoto ..... 123/446
4,841,765 A * 6/1989 Blanke ..... 73/119 A
4,886,029 A * 12/1989 Lill et al. ..... 123/479
4,928,228 A * 5/1990 Fujimoto et al. ..... 123/479
4,962,740 A * 10/1990 Fujimoto et al. ..... 123/198 DB
4,979,481 A * 12/1990 Shimomura et al. .. 123/198 DB
5,249,562 A * 10/1993 Klenk et al. ..... 123/481
5,408,974 A * 4/1995 Lipinski et al. ..... 123/481
5,483,941 A * 1/1996 Cullen et al. ..... 123/481
5,690,073 A * 11/1997 Fuwa ..... 123/443
5,809,973 A * 9/1998 Iida et al. ..... 123/179.16
5,868,116 A * 2/1999 Betts et al. ..... 123/481
5,970,943 A * 10/1999 Robichaux et al. ..... 123/198 F
6,009,857 A * 1/2000 Hasler et al. ..... 123/481
6,305,344 B1 * 10/2001 Perry ..... 123/198 F

* cited by examiner

*Primary Examiner*—Henry C. Yuen
*Assistant Examiner*—Hai Huynh

(57) ABSTRACT

A fuel delivery control system controls fuel delivery for an engine having a plurality of cylinders and a electronically controlled fuel injection unit for controlling fuel delivered to each cylinder in response to control signals generated by an electronic control unit. The control unit, for each cylinder, determines an engine acceleration value derived from a crank position value generated by an engine crank position sensor, compares the acceleration value to a threshold value, and terminates fuel delivery to only the cylinders for which the comparison indicates unsatisfactory combustion, up to one half of the cylinders. The control unit operates to deliver a normal amount of fuel to cylinders for which the comparison indicates satisfactory combustion, and to cylinders for which fuel delivery has been terminated for a pre-set maximum number of times.

22 Claims, 3 Drawing Sheets

ENGINE FUEL DELIVERY CONTROL SYSTEM

BACKGROUND OF THE INVENTION

Figure 1:
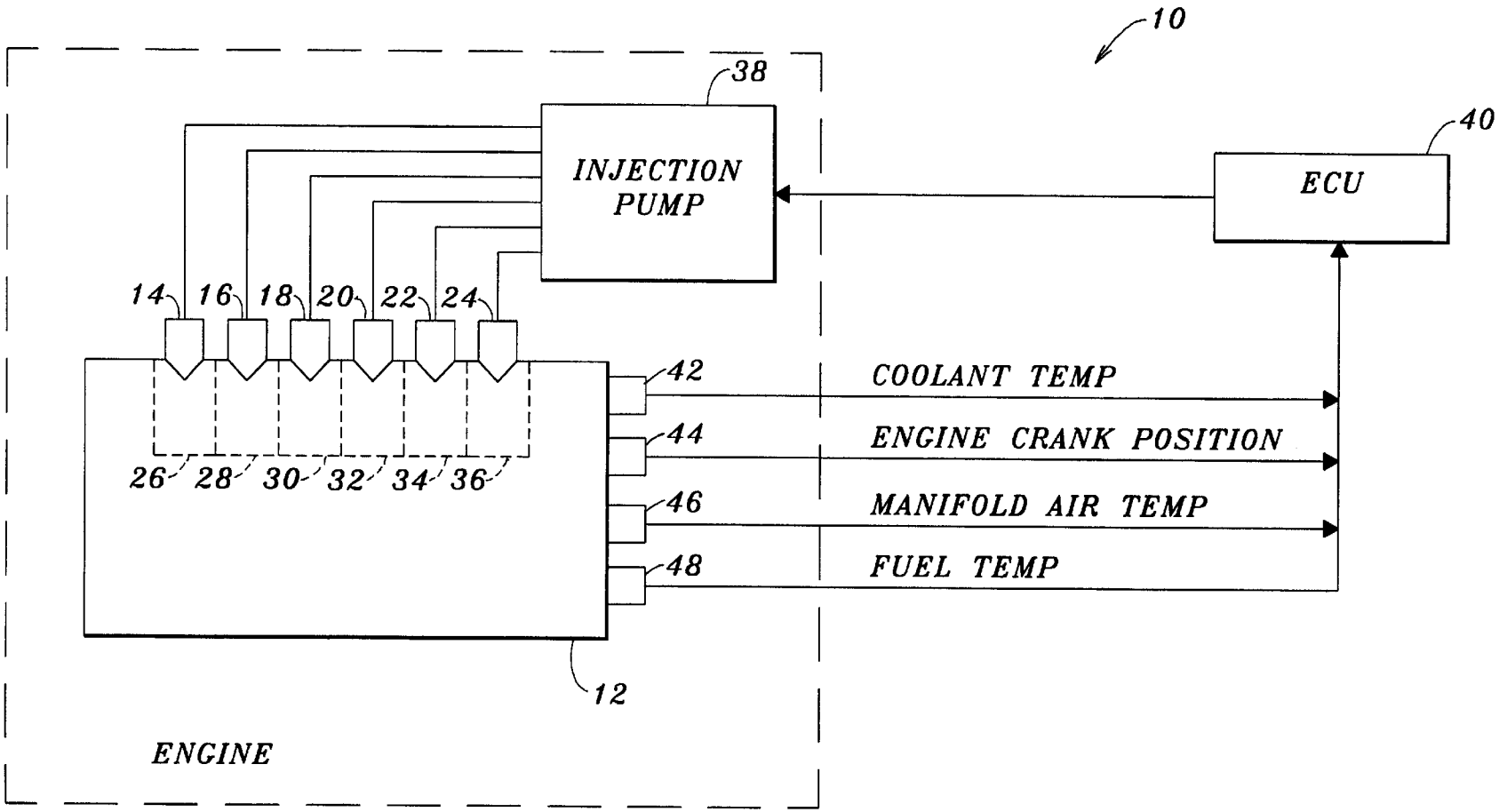

The invention relates to an engine control system, and more particularly to a control system and method for reducing white smoke from the exhaust of a compression ignition engine.

In compression ignition engines, if ignition fails to occur, fuel is expelled from the engine's exhaust system, as what is commonly referred to as white smoke. As a result of stricter governmental and consumer requirements for fuel economy, performance and emissions, the reduction of white smoke is desirable.

One system for reducing white smoke is described in U.S. Pat. No. 6,009,857, issued to Halser on Jan. 4, 2000. The Hasler patent discloses a cylinder cut-out system for a compression ignition engine having electronic unit injectors. The system includes an electronic controller which receives engine parameter sensor signals. In response to certain conditions of the sensor signals, the electronic controller deactivates a predetermined portion (half) of the electronic unit injectors.

U.S. Pat. No. 5,076,236, issued Dec. 31, 1991 to Yu, discloses a pressure responsive spring-biased cutoff valve for an open nozzle unit fuel injector in an internal combustion engine which allows for the selective operation of a given number of cylinders during an engine low load or idling speed condition for improved white smoke control. The 236 patent recognizes that white smoke can occur under low load or idling speed of an engine, and that "White smoke is a condition that results on engine start-up or low-load motoring conditions due to improper combustion of fuel because of insufficient compression or temperature levels".

In these prior art systems, a predetermined plurality or a given number of cylinders are shut off. The problem with such systems is that they may "shut off" a group of cylinders regardless of whether some of the cylinders in that group are firing efficiently or not. This requires additional amounts of fuel to be supplied to the cylinders which have not been disabled, subjecting them to additional work for a predetermined period of time to overcome the disabled cylinders.

Accordingly, it would be desirable to provide a system for reducing white smoke which shuts off only cylinders which are not firing properly.

SUMMARY OF THE INVENTION

Accordingly, an object of this invention is to provide an engine control system which efficiently reduces white smoke.

A further object of the invention is to provide such an engine control system which shuts off only cylinders which are not firing properly.

These and other objects are achieved by the present invention, wherein a fuel delivery control system controls fuel delivery for an engine having a plurality of cylinders and a fuel delivery control unit which delivers fuel to each cylinder in response to control signals generated by an electronic control unit. The electronic control unit, for each cylinder, determines a cylinder firing value which is related to a quality of combustion in that cylinder, compares the cylinder firing value to a threshold value, and terminates fuel delivery to only the cylinders for which the comparison indicates unsatisfactory combustion, up to a maximum portion of the total number of cylinders. The cylinder firing value is preferably an engine acceleration value derived from a crank position value generated by an engine crank position sensor. Once a cylinder is cut out, it is shut off for a certain number of times. After this cylinder has been shut off for this certain number of times, it is then provided with a normal amount of fuel so that it can be fired normally.

BRIEF DESCRIPTION OF THE INVENTION

Figure 2:
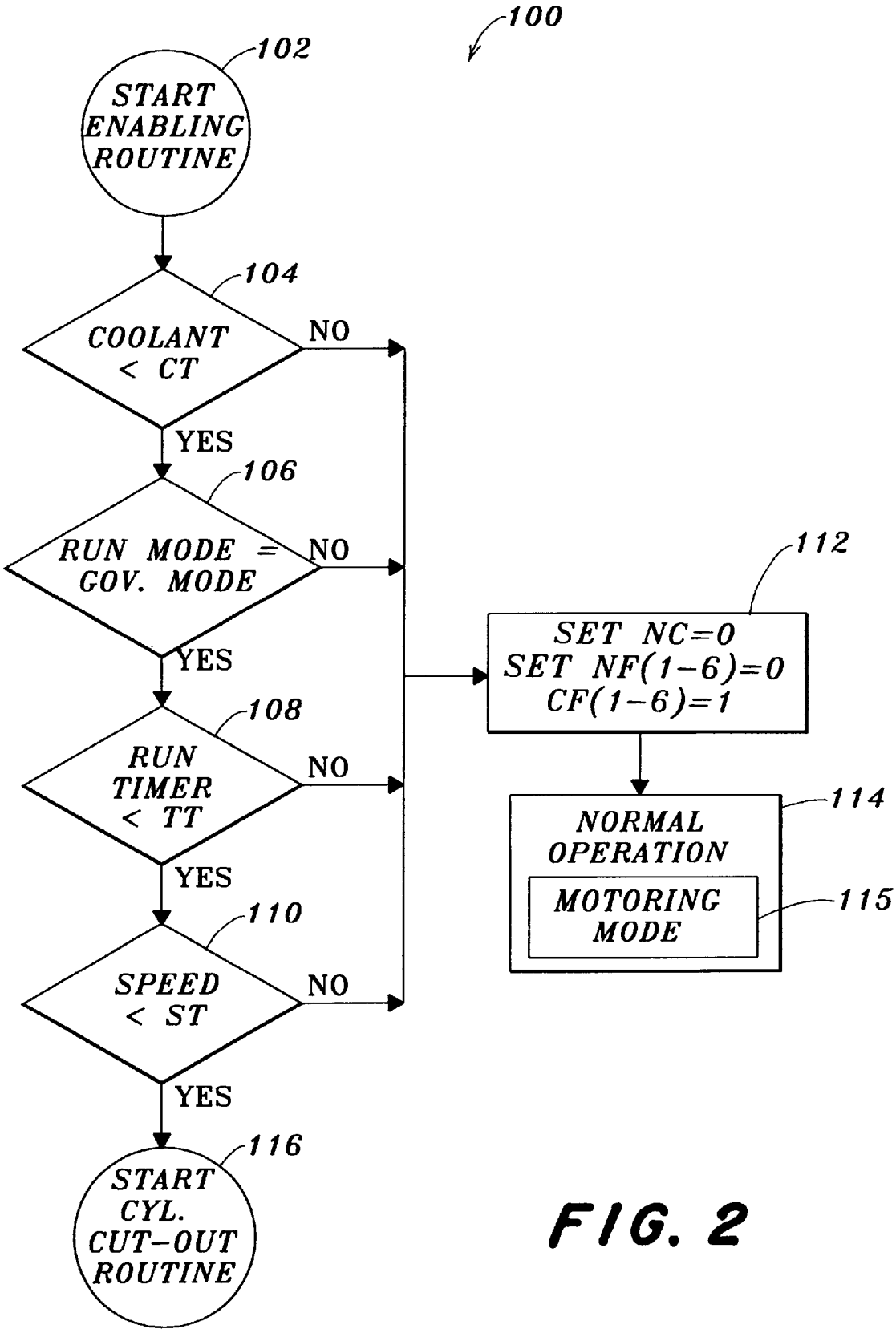
Figure 3:
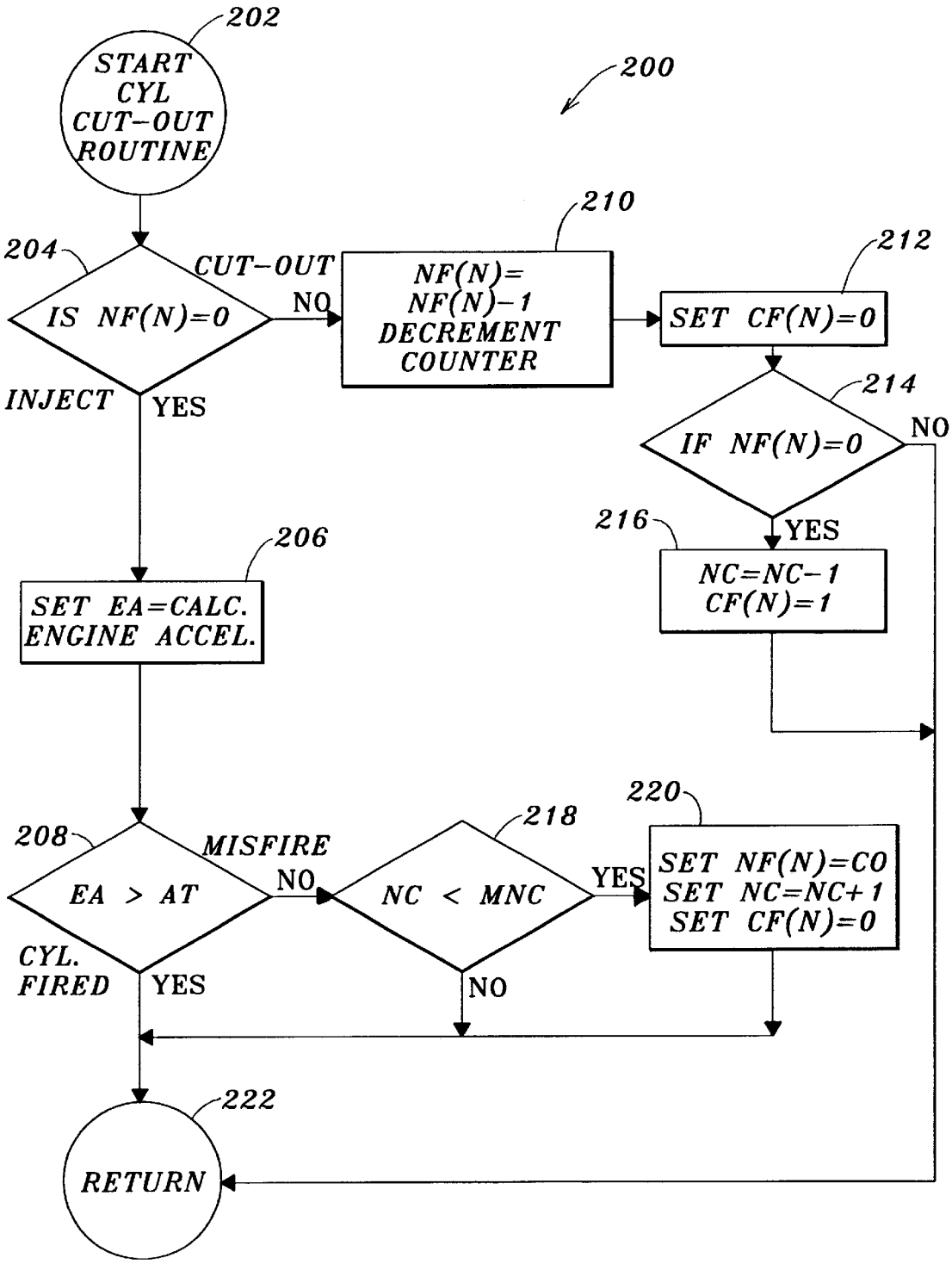

FIG. 1 is a simplified schematic diagram of an engine control system according to the present invention; and FIGS. 2 and 3 are logic flow diagrams illustrating an algorithm executed by the engine controller of FIG. 1.

DETAILED DESCRIPTION

A fuel delivery control system 10 controls fuel delivery to an engine 12 having a plurality of fuel injectors 14–24 supplying fuel to a corresponding plurality of cylinders 26–36. Fuel is supplied to the injectors 14–24 by a fuel delivery unit or injection pump 38, such as an electronically controlled rotary injection pump, such as made by Bosch, which permits individual control of the injectors and cylinders. Alternatively, the fuel delivery unit could be a high pressure common rail unit, unit injectors or a hydraulic electronic unit injectors. Although FIG. 1 shows an engine with six cylinders, the present invention is applicable to any engines having more than one cylinder.

A microprocessor-based engine control unit (ECU) 40 supplies control signals to the injection pump 38. The ECU 40 cooperates with the injection pump 38 and injectors 14–24 to control fuel delivery to the cylinders 26–36 of the engine 12 as a function of various sensed parameters and operator inputs, such as does the Focus™ controller which has been used on production John Deere engines. Like the Focus™ controller, the ECU calculates the amount of fuel to be delivered to the next cylinder to be fired, and causes the injection pump 38 to deliver that amount of fuel to the cylinder to be fired.

The ECU 40 generates control signals in response to a coolant temperature signal from coolant temperature sensor 42, a engine crank position signal from crank position sensor 44, a manifold air temperature signal from manifold air temperature sensor 46, and a fuel temperature signal from fuel temperature sensor 48. As did prior production John Deere Focus controllers, the ECU 40 includes a "motoring" mode or function 115, which shuts off fuel delivery to all cylinders during certain conditions, such as deceleration.

According to the present invention, the ECU 40 also continuously updates a cylinder index value, N, representing the particular cylinder which is in the process of firing. The ECU 40 also repetitively executes the algorithms 100 and 200, represented by the flow charts shown in FIGS. 2 and 3, respectively, once for each cylinder to be fired. The conversion of these flow charts into a standard language for implementing the algorithms described by the flow charts in a digital computer or microprocessor, will be evident to one with ordinary skill in the art.

Preferably, the amount of fuel to be delivered is calculated by ECU 40 as a function of a cylinder factor, CF(N), determined by algorithms 100 and 200 for each cylinder, N, as described below. For example, when CF(N)=0, no fuel will be delivered to the Nth cylinder, and when CF(N)=1, a normal amount of fuel will be delivered to the Nth cylinder. The cylinder index value, N, is set outside of algorithms 100 and 200, by the ECU 40 as a function of the crank position signal from sensor 44.

Referring now to FIG. 2, algorithm 100 determines whether or not the cylinder cut-out algorithm 200 will be executed. After starting at step 102, steps 104–110 direct the algorithm to step 116 and enables the cylinder cut-out algorithm 200 if all the following conditions are present: (104) coolant temperature is less than a maximum coolant temperature threshold, CT, (such as 50 degrees C), (106) the engine 12 is operating in a normal governor or "run mode", (108) a run timer value is less than a maximum operating time, TT, such as 5 minutes, and (110) engine speed (derived from crank position) is less than a maximum engine speed, ST, such as 1900 rpm. The normal governor or "run mode" can be defined as preferably the normal governor-controlled operating condition of the engine 12, and is an operating condition other than conditions such as a start-up condition, a fuel limiting or torque curve operating mode, and a stopped mode.

If any one of these conditions is not present, then step 112 sets an index value for the number of cylinders being cut-out, NC, to zero, since no cylinders will be cut out when the engine 12 is operating normally. Step 112 also sets the number of injection events to be cut-out, NF, for all cylinders, to zero, and sets the cylinder factor, CF, for all cylinders, equal to 1, and step 114 enables a normal operational mode (disables cylinder cut-out). The normal operational mode includes various conventional engine operating modes, including a motoring mode 115, wherein fuel supply is terminated to all cylinders, such as during deceleration of the engine 12. Preferably, as a result of steps 106 and 110, the cylinder cut-out algorithm 200 is enabled when the engine speed is within a range of approximately 700 to 1900 rpm, but these speeds are merely exemplary and could be varied without departing from the invention.

Referring now to FIG. 3, algorithm 200 is entered at step 202, whenever algorithm 100 executes step 116 and enables cylinder cut-out. The first time algorithm 200 is executed, the values NF(1–6)=0, NC=0 and CF(1–6)=1 are what was established by a previous operation of step 112 of algorithm 100. In subsequent operations of algorithm 200, these values are set, decremented or increment within algorithm 200, and those modified values will continue to be set and used by algorithm 200 until algorithm 100 once again disables cylinder cut-out and the values are re-initialized by step 112.

Step 204 compares NF(N) to zero, and if NF(N) is not equal to zero (this means that cylinder N has been cut-out), then step 210 decrements the counter value NF(N) by 1, and step 212 sets CF(N) equal to zero (to cause the Nth cylinder to be cut-out).

Then, in step 214, if NF(N) is not equal to zero, it means that the Nth cylinder has been cut-out less than CO or 50 times, for example, and step 214 directs the subroutine to step 222 so that the Nth cylinder will be cut-out due the step 212. If in step 214, NF(N) is equal to zero, it means that the Nth cylinder has been cut-out the maximum allowed number of times, CO, and step 214 directs the subroutine to step 216 which decrements NC by 1 (to indicate that the number of cylinders being cut-out is being reduced) and sets CF(N) equal to 1 so that the Nth cylinder will be fired (not cut-out) during the next series of cylinder firings, and then directs the subroutine to return via step 222.

Referring back again to step 204, if NF(N) equals zero, (this means that the Nth cylinder is not going to be cut-out), then step 206 sets EA equal to a calculated engine acceleration, and step 208 compares EA to an acceleration threshold, AT. Preferably, the control unit 40 calculates or derives, from the crank angle or position signal, for each cylinder, the engine acceleration resulting from operation of a particular cylinder, such as by determining the derivative of the engine speed signal which is derived from the crank position signal.

Then, if in step 208 EA is greater than an acceleration threshold, AT, it means that cylinder N fired normally and the subroutine returns at step 222 with CF(N)=1 for the Nth cylinder. If, in step 208 EA is not greater than AT, it means that cylinder N has misfired and the subroutine proceeds to step 218.

Step 218 compares the number of cylinders currently being cut-out, NC, to a maximum number, MNC, such as half of the total number of cylinders in the engine 12. If, in step 218, NC is not less than MNC, it means that no additional cylinders are to be cut-out, and the algorithm is directed to step 222. If, in step 218, NC is less than MNC, it means that additional cylinders can be cut-out and the algorithm is directed to step 220. Step 220 sets the index value NF(N) equal to CO, the number of times (such as 50) a cylinder should be cut-out after a misfire is detected. Step 220 also increments NC by 1 (to indicate that an additional cylinder will be cut-out) and sets CF(N) equal to zero so that cylinder N will be cut-out during the next series of cylinder firings.

Thus, the ECU 40 determines if a particular cylinder or cylinders are misfiring, and cut-outs only the cylinders which are misfiring, while disabling at most only half of the cylinders. Thus, this system does not automatically shut off a predetermined, selected group of cylinders, but instead, detects which cylinder(s) are actually misfiring by measuring the amount acceleration of the crankshaft, and shuts off the fuel supply only to the misfiring cylinders. Acceleration and cylinder misfiring is detected by using an engine crank position sensor, and measuring the time period between pulses from the crank position sensor. Once it is determined that a particular cylinder is not firing, that cylinder is shut off for a certain number of engine cycles. After that number of engine cycles, that cylinder is injected with the normal amount of fuel (steps 214, 216 and 222).

While the present invention has been described in conjunction with a specific embodiment, it is understood that many alternatives, modifications and variations will be apparent to those skilled in the art in light of the foregoing description. Accordingly, this invention is intended to embrace all such alternatives, modifications and variations which fall within the spirit and scope of the appended claims.

What is claimed is:

1. A fuel delivery control system for a compression ignition engine having a plurality of cylinders and a fuel delivery unit for controlling fuel delivered to each cylinder in response to control signals communicated to the fuel delivery unit, and a control unit for generating said control signals, the improvement wherein:

the control unit which has a cylinder cut-out operational mode, wherein, for each cylinder, the control unit determines a cylinder firing value which is related to a quality of combustion in said cylinder, compares said cylinder firing value to a threshold value, and terminates fuel delivery to only the cylinders for which said comparison indicates unsatisfactory combustion, and the control unit causing normal amounts of fuel to be delivered to cylinders for which said comparison indicates satisfactory combustion; and the control unit has a disabling operational mode which disables the cylinder cut-out operational mode if the engine is not operating in a normal governed mode.

2. The fuel delivery control system of claim 1, further comprising:

an engine crank position sensor for generating a crank position signal, the control unit receiving the crank position signal and generating the control signals which are communicated to the fuel delivery unit, the control unit determining, for each cylinder, from the crank position signal, the cylinder firing value.

3. The fuel delivery control system of claim 2, wherein:

the control unit derives, for each cylinder and from the crank position signal, an engine acceleration value representing an acceleration of the engine resulting from operation of said cylinder, compares said engine acceleration value to a threshold value, and terminates fuel delivery to only the cylinders for which said comparison indicates unsatisfactory combustion, and the control unit causing normal amounts of fuel to be delivered to cylinders for which said comparison indicates satisfactory combustion.

4. The fuel delivery control system of claim 1, wherein:

the control unit monitors a number of times a particular cylinder has received no fuel, and the control unit causing normal amounts of fuel to be delivered to a cylinder when said number of times exceeds a predetermined limit for said particular cylinder.

5. The fuel delivery control system of claim 1, wherein:

the control unit sets a cylinder cut-out number value to a stored value representing a desired number of times a particular cylinder can be provided with no fuel, decrements the cylinder cut-out number value each time said particular cylinder is provided with no fuel, and provides said cylinder with a normal amount of fuel when the cylinder cut-out number value equals zero.

6. The fuel delivery control system of claim 1, wherein:

the control unit has a disabling operational mode which disables the cylinder cut-out operational mode if a coolant temperature is not less than a maximum coolant temperature threshold.

7. The fuel delivery control system of claim 6, wherein:

the maximum coolant temperature threshold is approximately 50 degrees C.

8. The fuel delivery control system of claim 1, wherein:

the control unit has a disabling operational mode which disables the cylinder cut-out operational mode if the engine is operating in a start-up situation.

9. The fuel delivery control system of claim 1, wherein:

the control unit has a disabling operational mode which disables the cylinder cut-out operational mode if the engine has been running for at least a certain amount of time.

10. The fuel delivery control system of claim 1, wherein:

the control unit has a disabling operational mode which disables the cylinder cut-out operational mode if a speed of the engine speed is not less than a maximum engine speed value.

11. The fuel delivery control system of claim 1, wherein:

the control unit has an enabling operational mode which enables the cylinder cut-out operational mode if an engine coolant temperature is less than a maximum coolant temperature threshold, the engine is not operating in a start-up mode, the engine has been running for less than a maximum operating time, and a speed of the engine is less than a maximum engine speed.

12. The fuel delivery control system of claim 1, wherein:

the control unit also has an operational mode wherein fuel delivery to all cylinders is terminated.

13. The fuel delivery control system of claim 1, wherein:

the fuel delivery unit comprises an electronically controlled rotary injection pump which permits individual control of a plurality of fuel injectors, each fuel injector being associated with a corresponding one of the cylinders.

14. The fuel delivery control system of claim 1, further comprising:

the control unit, for each cylinder, determines an engine acceleration value representing an acceleration of the engine resulting from operation of said cylinder, compares said engine acceleration value to a threshold value, and terminates fuel delivery to only the cylinders for which said comparison indicates unsatisfactory combustion, and the control unit causing normal amounts of fuel to be delivered to cylinders for which said comparison indicates satisfactory combustion.

15. A fuel delivery control system for a compression ignition engine having a plurality of cylinders and a fuel delivery unit for controlling fuel delivered to each cylinder in response to control signals communicated to the fuel delivery unit and a control unit for generating said control signals, wherein:

the control unit has a cylinder cut-out operational mode, wherein, for each cylinder, the control unit determines a cylinder firing value which is related to a quality of combustion in said cylinder, compares said cylinder firing value to a threshold value, and terminates fuel delivery to only the cylinders for which said comparison indicates unsatisfactory combustion, and the control unit causing normal amounts of fuel to be delivered to cylinders for which said comparison indicates satisfactory combustion; and the control unit having an enabling operational mode which enables the cylinder cut-out operational mode only if an engine coolant temperature is less than a maximum coolant temperature threshold, the engine is operating in a normal governed mode, the engine has been running for less than a maximum operating time, and a speed of the engine is less than a maximum engine speed.

16. A fuel delivery control system for a compression ignition engine having a plurality of cylinders and a fuel delivery unit for controlling fuel delivered to each cylinder in response to control signals communicated to the fuel delivery unit, the control system comprising:

a control unit, which, for each cylinder, determines an engine acceleration value representing an acceleration of the engine resulting from operation of said cylinder, compares said engine acceleration value to a threshold value, and terminates fuel delivery to only the cylinders for which said comparison indicates unsatisfactory combustion, and the control unit causing normal amounts of fuel to be delivered to cylinders for which said comparison indicates satisfactory combustion; and the control unit having a disabling operational mode which disables the cylinder cut-out operational mode if the engine is not operating in a normal governed mode.

17. The fuel delivery control system of claim 16, further comprising:

an engine crank position sensor for generating a crank position signal, the control unit receiving the crank position signal and deriving the engine acceleration value therefrom.

18. A method for controlling fuel delivery to a compression ignition engine having a plurality of cylinders, comprising:

determining, for each cylinder, a cylinder firing value which is related to a quality of combustion in said cylinder;

comparing said cylinder firing value to a threshold value;

terminating fuel delivery to only the cylinders for which said comparison indicates unsatisfactory combustion;

delivering a normal amount of fuel to cylinders for which said comparison indicates satisfactory combustion; and preventing termination of fuel delivery if an engine coolant temperature is not less than a maximum coolant temperature threshold, or the engine is not operating in a normal governed operational mode, or the engine has been running for not less than a maximum operating time, or a speed of the engine is not less than a maximum engine speed.

19. The method of claim 18, further comprising:

comparing a number of consecutive times fuel delivery has been terminated for a particular cylinder to a desired maximum number of consecutive times a particular cylinder can be cut out; and delivering a normal amount of fuel to said cylinder when said comparison indicates that fuel delivery to said cylinder has been terminated for said maximum number of times.

20. The method of claim 18, further comprising:

terminating fuel delivery to all the cylinders while the engine is operating under certain conditions.

21. The method of claim 18, further comprising:

setting a cylinder cut-out number value to a stored value representing a desired number of times a particular cylinder can be provided with no fuel;

decrementing the cylinder cut-out number value each time said particular cylinder is provided with no fuel; and providing said cylinder with a normal amount of fuel when the cylinder cut-out number value equals zero.

22. The method of claim 18, wherein:

the maximum coolant temperature threshold is approximately 50 degrees C.

* * * * *